United States Patent [19]

Höllrigl et al.

[11] 3,959,090

[45] May 25, 1976

[54] CONTINUOUS ELECTROLYTE COLORING OF A PRE-ANODISED ALUMINUM FOIL OR STRIP

[75] Inventors: Günter Höllrigl, Schaffhausen; Ladislav Sandera, Neuhausen am Rheinfall, both of Switzerland

[73] Assignee: Swiss Aluminium Ltd., Chippis, Switzerland

[22] Filed: July 28, 1975

[21] Appl. No.: 599,393

[30] Foreign Application Priority Data

July 31, 1974 Switzerland ..... 10561/74

[52] U.S. Cl. ..... 204/28; 204/35 N; 204/58

[51] Int. Cl.[2] ..... C25D 11/22

[58] Field of Search ..... 204/28, 58, 35 N

[56] References Cited

UNITED STATES PATENTS

| | | | |
|---|---|---|---|
| 3,079,308 | 2/1963 | Ramirez et al. | 204/28 |
| 3,759,801 | 9/1973 | Patrie et al. | 204/35 N |
| 3,766,043 | 10/1973 | Herrmann et al. | 204/28 |

*Primary Examiner*—R. L. Andrews
*Attorney, Agent, or Firm*—Ernest F. Marmorek

[57] ABSTRACT

Continuous process for anodizing and subsequent electrolytic coloring of an aluminium strip or foil with A.C. in which the strip after leaving the anodistaion unit passes through an aqueous acidic contacting electrolyte, e.g. dilute sulfuric acid, and then through the aqueous acidic coloring electrolyte containing metal ions and in which the A.C. source is connected to inert electrodes dipping in the contacting and in the coloring electrolyte respectively.

13 Claims, 1 Drawing Figure

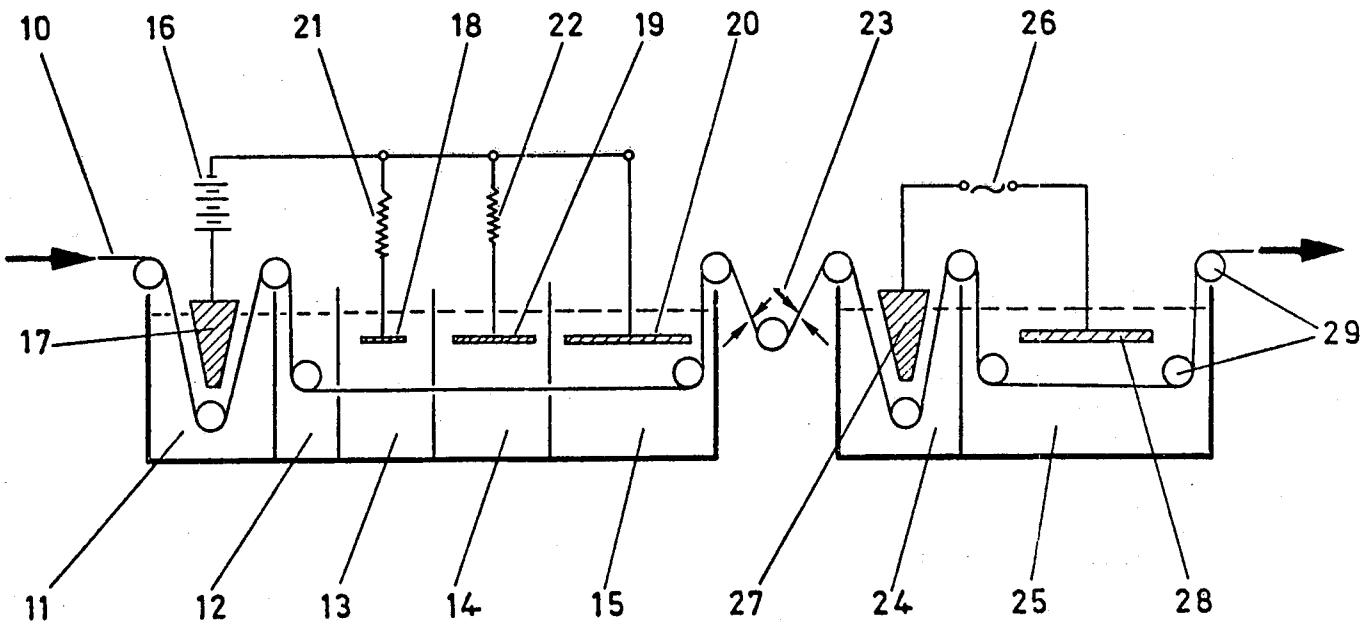
10
16
21
18
22
19
20
23
26
17
11
12
13
14
15
27
24
25
28
29

CONTINUOUS ELECTROLYTE COLORING OF A PRE-ANODISED ALUMINUM FOIL OR STRIP

The invention concerns a process for anodically oxidising and then coloring the oxide layer so formed on an aluminium strip or foil by means of a continuous process.

Processes are known wherein an aluminium article is anodised and the formed oxide layer is colored by electrolytic treatment in an acidic, aqueous metal salt solution.

If an aluminium foil or strip is continuously anodised by passing continuously through an electrolyte, then both sides are covered completely with an oxide layer. Since aluminium oxide is electrically insulating further direct mechanical contact with a power source for subsequent electrolytic coloring of the strip or foil is impossible. This is also the case when an aluminium strip or foil, coated on one side with an electrically non-conductive material (e.g. plastic, paper), is to be anodised and colored.

It is known that the oxide layer has the effect of a rectifier on the alternating current which results in an asymmetry in the passage of current, thus making possible the metal-ion reduction. It is therefore not possible with alternating current to have two previously anodised aluminium articles connected as electrode and counter-electrode in order to achieve reproducible coloring within a reasonable time by metallic precipitation on the surfaces of both articles. On the contrary a counter electrode made of another material must be employed.

The object of the invention presented here is to produce a process whereby not only the anodic oxidation of an aluminium strip or foil by a known method is carried out in a continuous process, but also the electrolyte coloring of the resultant oxide layer with alternating current is made possible in a continuous process, and in which process the difficulties mentioned earlier are avoided.

The object is fulfilled in terms of the invention in that the aluminium strip or foil, after leaving the unit for anodic oxidation, is passed first through an aqueous contacting electrolyte and then an aqueous coloring electrolyte, which contains metal ions and which is separate from the contacting electrolyte, and the alternating current for electrolytic precipitation of the metal ions is supplied to the strip or foil via an inert electrode in the contacting electrolyte and via at least one inert electrode in the coloring electrolyte without direct mechanical contact and with asymmetry of polarity.

The contact electrolyte has the advantage that, unlike mechanical contacting, the power is supplied to the strip or foil via the electrically conductive fluid which remains behind in the pores of the aluminium oxide layer from the previous anodising step.

With the process of the invention and when alternating current is applied to coloring inert electrodes the necessary asymmetry of polarity is achieved if the electrochemical processes in the contacting and in the coloring electrolytes are different from one another. The electrolytes are therefore chosen such that metal is deposited only in the coloring electrolyte and never in the contacting electrolyte.

It has been found that the voltage (potential difference) between the inert electrodes, which for example may be made of graphite or platinised metal, and the aluminium strip or foil in the coloring electrolyte, must be higher than that in the contacting electrolyte. This contacting electrolyte is advantageously chosen so that the voltage in the contacting electrolyte amounts to at most 10% of the total voltage between the inert electrode. From this asymmetry of the voltages in the contacting and coloring electrolytes, there results the necessary cathodic excess current in the coloring electrolyte, thanks to which the metal ions of the coloring electrolyte are reduced and precipitated as a metallic deposit in the pores the oxide layer of the aluminium strip or foil. A suitable acid for the contacting electrolyte is in principle any acid which in the anodic phase of the alternating current permits a further oxidation and furthermore achieves the desired asymmetry. Advantageously dilute sulphuric acid with a concentration of 5 to 300 g/l is used as the contacting electrolyte. By preference a relatively weak concentration of 10 to 30 g/l is used, since contamination of the coloring electrolyte due to incidental transfer of the contacting electrolyte into the coloring electrolyte is thus reduced to a minimum.

Between the contacting electrolyte and the coloring electrolyte the aluminium strip or foil can pass through a wiping device or possibly through a rinsing unit, in particular if the coloring is carried out in an electrolyte of low acidity.

The generally known coloring electrolyte is either a strongly acidic metallic salt electrolyte containing e.g. copper, tin, silver and/or thallium ions, or a weakly acidic metal salt electrolyte containing e.g. nickel, cobalt, cadmium and/or iron ions. In both cases the coloring electrolyte can contain further, generally well known additions such as for example inorganic and/or organic acids.

A strongly acidic electrolyte containing 2 to 10 g/l of thallium sulphate was found for example to be particularly useful for rapid production of an intensive black coloring.

The desired color tone is achieved by varying the colouring parameters such as voltage, type of metal ion, duration of coloring stage.

The anodising and electrolytic coloring processes run continuously at the same strip speed which can be adjusted with appropriate choice of anodising and coloring bath parameters so that the desired color tone can be selected from a wide range.

The invention is explained in greater detail with the aid of a drawing. This shows schematically a device for carrying out the continuous through-put process for the anodic oxidation and electrolyte coloring of an aluminium strip or foil without direct mechanical contacting of the strip or foil during the coloring stage.

An aluminium strip 10, with one side covered with an electrically non conductive material, is deflected by support rolls and passes through first a contact cell 11 and four anodising cells 12, 13, 14, 15 of a generally well known anodising unit. A power source 16 supplies direct current which reaches the aluminium strip 10 via an insoluble anode 17 and the dilute, aqueous sulphuric acid. In the anodising cells 13, 14, 15 there are arranged the corresponding cathodes 18, 19, 20 of a metal such as Pb or Al, which make possible the passage of the current through the anodising electrolyte. The larger resistance 21 and the smaller one 22 cause the strip in the first cells, where the oxide layer begins to grow or is still thin, to receive not too much current.

The surface area of strip in the anodising cells is likewise increased in the direction towards the exit end of the unit.

After leaving the anodising tank the aluminium strip is cleaned on both sides with water sprayed from the sprays 23 and passes immediately into the electrolytic contacting cell 24 containing the contacting electrolyte and then into the coloring cell 25 which is separate from the contacting cell and is filled with the coloring electrolyte containing metal salts. Here the electrolytic coloring takes place by means of the alternating current which has for example a frequency of 50 Hz and a change of polarity which follows a characteristic sine wave. The electrical circuit supplied from an a.c. source 26, neglecting cables and electrolytes, consists of a graphite electrode 27 in the contacting electrolyte, the aluminium strip 10 and a further graphite electrode 28 in the coloring electrolyte. If the aluminium strip is bare, u.e. has no coating of any kind added, but is only covered on both sides with an oxide layer then a second graphite electrode can be provided and arranged symmetrically with respect to the aluminium strip.

The total voltage $E_{tot}$ between the two graphite electrodes 27 and 28 is divided into the actual coloring or precipitation voltage $E_f$ between the electrode 28 and the aluminium strip, and the contact voltage $E_K$ between the electrode 27 and the aluminium strip; the other components which make up $E_{tot}$ are negligably small, therefore it can be taken that, $$E_{tot} = E_F + E_K$$

For the continuous process of the invention the following condition must be met $$E_K < E_F,$$

preferably $$E_K \leq (1/10) \cdot E_{tot}$$

In accordance with the choice made for the most important parameters viz., type of metal ion, voltage and duration of the coloring stage, the aluminium strip is colored to the wanted color tone in the coloring bath by the reduction of the metal ions in the oxide pores.

Example 1

An aluminium foil coated on one side with an insulating material was oxidised to give it a 6 to 8 $\mu$m thick oxide layer, in a strip anodising unit as shown in the drawing. The strip speed was 0.5 m/min. After rinsing with water the strip passed first into a contacting cell containing an aqueous electrolyte with 20 g/l $H_2SO_4$ and fitted with a graphite electrode, and then into a coloring cell containing an aqueous electrolyte with 20 g/l $CuSO_4$ and 7 g/l $H_2SO_4$, and fitted with a counter-electrode, likewise made of graphite. After applying a voltage of 11 volts between the graphite electrodes the foil in the coloring electrolyte was coloured as follows:

After 3 min: light pink
After 6 min: copper-red
After 8 min: dark red

The various coloring times are achieved by the sideways adjustment of the exit roll 29 in the coloring tank, to produce the desired duration of treatment in the electrolyte for the aluminium foil whereby in order to ensure an uniform distribution of current the arrangement of the graphite electrode (s) in the coloring bath has to be adapted to the particular length of the immersed aluminium foil.

EXAMPLE 2

An aluminium foil coated on one side with an insulating material was colored in accordance with the details given in example 1 whereby, however the aqueous coloring electrolyte contained 25 g/l $SnSO_4$ and 7 g/l $H_2SO_2$. A voltage of 15 volts was applied between the graphite electrode. The following range of colors was achieved:

After 3 min: light bronze
After 5 min: dark bronze
After 8 min: brown
After 10 min: dark brown
After 13 min: black

EXAMPLE 3

An aluminium foil coated on one side with an insulating material was colored in accordance with the details given in example 1, whereby, however, the aqueous coloring electrolyte contained 8 g/l $Tl_2SO_4$ and 7 g/l $H_2SO_4$. A voltage of 14 volts was applied between the graphite electrodes. The following range of colors was then achieved:

After 1 – 2 min: bronze min:
After 3 min: dark brown
After 5 min: black

With an electrolyte which contains thallium ions a deep black color may be obtained very rapidly.

EXAMPLE 4

An aluminium foil coated on one side with an insulating material was colored in accordance with the details given in example 1 whereby the aqueous coloring electrolyte contained 120 g/l $NiSO_4$, 6 $H_2O$ and 40 g/l boric acid. A voltage of 14 or 16 volts was applied between the graphite electrodes. The following color tones were then obtained:

14 v, 3 min: light bronze
16 v, 3 min: medium bronze 16 v, 6 min : dark bronze In all examples described it would have been possible to apply a somewhat higher or lower voltage which would have produced the same desired color tone in a shorter or longer coloring time respectively, as is known from classical electrolytic coloring.

The process according to the invention has the advantage that the electrical circuit for coloring is separate from the electrical circuit for anodising and the current used for coloring can therefore be controlled easily and independently from the direct current conditions used for anodising.

What we claim is:

1. A continuous process for anodic oxidation of an aluminum strip or foil to form an oxide layer and subsequent electrolytic coloring of the oxide layer by means of alternating current, said process comprising the steps of:

subsequent to the anodic oxidation, passing said aluminum through an aqueous contacting electrolyte;

thereafter, passing said aluminum through an aqueous coloring electrolyte comprising metal ions, said contact and coloring electrolytes being separated from each other;

disposing a first inert electrode in said contacting electrolyte;

disposing at least a second inert electrode in said coloring electrolyte; and applying an alternating current to said first and second electrodes to precipitate said metal ions without any direct physical contact with said aluminum, the potential difference between said first electrode and said aluminum being less than the potential difference between said aluminum and said second electrode.

2. The process as claimed in claim 1, wherein the potential difference between said first electrode and said aluminum is less than about 10 per cent of the total potential difference between said first and second electrodes.

3. The process as claimed in claim 2, wherein said contact electrolyte is an acid which permits further oxidation to occur in the anodic phase of the alternating current.

4. The process as claimed in claim 3, wherein said contact electrolyte includes dilute sulphuric acid having a concentration of from about 5 to about 300 g/l.

5. The process as claimed in claim 4, wherein a concentration of the dilute sulphuric acid is from about 10 to about 30 g/l.

6. The process as claimed in claim 2, wherein said contact electrolyte is a strong acid of the kind used for the anodic oxidation of aluminum.

7. The process as claimed in claim 1, further comprising the step of adjusting the duration of said aluminum in said coloring electrolyte, whereby a predetermined coloring of said aluminum is obtained.

8. The process as claimed in claim 7, wherein the duration of contact of said aluminum in said coloring electrolyte is ensured by adjusting the length of the path of said aluminum in said electrolyte in accordance with the transfer velocity of said aluminum and changing the relative position of said electrodes accordingly, whereby a predetermined coloring of said aluminum is obtained.

9. The process as claimed in claim 1, wherein said first and second electrodes are graphite electrodes.

10. The process as claimed in claim 1, wherein said coloring electrolyte is strongly acidic and said metal ions are selected from the group consisting of copper, tin, silver and thallium.

11. The process as claimed in claim 10, wherein the metal salts are of thallium and said coloring electrolyte has a concentration of from about 2 to about 10 g/l of thallium sulphate.

12. The process as claimed in claim 1, wherein said coloring electrolyte is weakly acidic and said metal ions are selected from the group consisting of nickel, cobalt, cadmium and iron.

13. The process as claimed in claim 10, further comprising the step of changing the relative position of said electrodes, whereby a predetermined coloring of said aluminum is obtained.

* * * * *